US010695687B2

(12) United States Patent
Fernandez et al.

(10) Patent No.: US 10,695,687 B2
(45) Date of Patent: Jun. 30, 2020

(54) MODEL TOY CROMS BALLS

(71) Applicants: Darwin William Fernandez, Granada (MX); Ivan Fernandez, Granada (MX)

(72) Inventors: Darwin William Fernandez, Granada (MX); Ivan Fernandez, Granada (MX)

(73) Assignees: Darwin William Fernandez, Granada (MX); Ivan Fernandez, Granada (MX)

( * ) Notice: Subject to any disclaimer, the term of this patent is extended or adjusted under 35 U.S.C. 154(b) by 0 days.

(21) Appl. No.: 15/877,147

(22) Filed: Jan. 22, 2018

(65) Prior Publication Data

US 2019/0099684 A1 Apr. 4, 2019

(51) Int. Cl.
*A63H 33/00* (2006.01)
*A63B 43/00* (2006.01)

(52) U.S. Cl.
CPC ..... *A63H 33/003* (2013.01); *A63B 43/00* (2013.01)

(58) Field of Classification Search
CPC ..... A63H 33/003; A63B 43/00
See application file for complete search history.

(56) References Cited

U.S. PATENT DOCUMENTS

| | | | | |
|---|---|---|---|---|
| 1,207,200 | A | 12/1916 | Novak | |
| 1,585,887 | A | 8/1925 | Beach | |
| 1,657,175 | A | 5/1926 | Peace | |
| 2,968,121 | A | 4/1958 | Pearson, Jr. et al. | |
| 3,798,835 | A | 3/1974 | McKeehan | |
| 4,205,482 | A | 6/1980 | Christiansen et al. | |
| 4,519,786 | A | 5/1985 | Larws | |
| 4,687,459 | A | 8/1987 | Lockett | |
| 4,698,043 | A | 10/1987 | May et al. | |
| 4,736,943 | A | 4/1988 | Fukuda et al. | |
| 4,817,936 | A | 4/1989 | Matsuda | |
| 5,098,327 | A | 3/1992 | Ferrero | |
| 5,162,013 | A | 11/1992 | von Mohr | |
| 5,297,981 | A | 3/1994 | Maxim | |
| 5,409,414 | A * | 4/1995 | Sheang | A63H 33/005 446/443 |

(Continued)

FOREIGN PATENT DOCUMENTS

| | | |
|---|---|---|
| CN | 206793044 U | 12/2017 |
| EP | 2116289 A1 | 11/2009 |

OTHER PUBLICATIONS

International Search Report and Written Opinion (PCT/US2018/053900) [SR/KR] dated Feb. 1, 2019.

*Primary Examiner* — Jeffrey S Vanderveen
(74) *Attorney, Agent, or Firm* — Edwin S. Flores; Daniel J. Chalker; Chalker Flores, LLP

(57) ABSTRACT

The present invention includes a toy with a retractable mechanism capable of transforming its original compact shape into a new entity, comprising: a hollow sphere (1) provided with a cut on the lower part thereof (2), on the upper end a convex protuberance is projected (3), provided with a modified asymmetric cylinder, which reduces its size in the upper end assimilating the neck of the body of the sphere (4), formed by two hinges of plastic material adjoined to both caps (5); and two internal springs that maintain these hinges under tension to maintain the body inside the sphere (6) which, when pressed, activates the operation of the main spring (7) in such a way that, when the sphere (1) receives a strike or is pressed, an identity different from the initial one is shown.

14 Claims, 8 Drawing Sheets

(56) References Cited

U.S. PATENT DOCUMENTS

| | | | | |
|---|---|---|---|---|
| 5,525,090 | A | 6/1996 | Halford et al. | |
| 5,871,386 | A | 2/1999 | Bart et al. | |
| 5,893,789 | A | 4/1999 | Wu | |
| 5,924,909 | A | 7/1999 | Yamakawa | |
| 5,924,910 | A | 7/1999 | Liu | |
| 6,231,346 | B1 * | 5/2001 | Sagi-Dolev | G09B 19/00 434/225 |
| 6,468,126 | B1 | 10/2002 | Herber | |
| 6,536,145 | B2 | 3/2003 | Burtch et al. | |
| 6,761,612 | B1 | 7/2004 | Pencil et al. | |
| 7,166,047 | B2 * | 1/2007 | May | A63B 43/00 473/569 |
| 7,306,504 | B2 | 12/2007 | Saucier | |
| 7,458,874 | B2 | 12/2008 | Rung | |
| 7,553,209 | B1 | 6/2009 | Sorensen | |
| 8,066,542 | B2 | 11/2011 | Ejima | |
| 8,500,508 | B2 | 8/2013 | Yamada et al. | |
| 8,517,791 | B2 | 8/2013 | Yamada | |
| 8,974,264 | B2 | 3/2015 | McCafferty et al. | |
| 9,308,461 | B2 | 4/2016 | Yamada et al. | |
| 9,694,295 | B2 | 7/2017 | Walterscheid | |
| 9,975,058 | B2 * | 5/2018 | Yamada | A63H 33/003 |
| 2014/0094082 | A1 * | 4/2014 | Swartz | A63H 33/003 446/73 |
| 2015/0238880 | A1 | 8/2015 | Austin | |
| 2016/0214025 | A1 | 7/2016 | Yamada et al. | |
| 2016/0361661 | A1 | 12/2016 | Tiefel et al. | |

* cited by examiner

MODEL TOY CROMS BALLS

CROSS-REFERENCE TO RELATED APPLICATIONS

This application is a continuation-in-part of, and claims priority to, Mexican Patent Application No. MX/f/2017/003251, filed Oct. 20, 2017, and Chilean Patent Application No. 2017-02489, filed Mar. 10, 2017, the entire contents of each of which is incorporated herein by reference.

STATEMENT OF FEDERALLY FUNDED RESEARCH

None.

TECHNICAL FIELD OF THE INVENTION

The present invention relates in general to the field of model toys.

BACKGROUND OF THE INVENTION

Without limiting the scope of the invention, its background is described in connection with model toys.

One such toy is taught in U.S. Pat. Nos. 9,308,461 and 8,500,508, issued to Yamada, et al., entitled "Transformable toy", teach a toy with an exterior structure that is constructed to transform from a rollable first shape to a second shape. An interior structure inside the exterior structure is endowed with a magnetic body that moves by way of a magnetic force that acts from the exterior of the toy, an interior locking portion that moves simultaneously with the movement of this magnetic body, and a biasing member that effects a force which moves or turns this interior locking portion in a particular direction. According to this invention, if the magnetic force does not act from the exterior of the toy, the first shape of the exterior structure maintained. In the event that a magnetic force has acted from the exterior of the said toy, the exterior structure transforms from the first shape to the second shape.

Another such toy is taught in U.S. Pat. No. 7,166,047, issued to May, et al., entitled, "Toy ball", which teaches a toy ball that is formed from two shells and a pair of lock mechanisms. During construction, the shells, which may be hemispherical, are mated together and then the lock mechanisms are secured to the shells to form a substantially smooth-surfaced sphere, wherein the lock mechanisms provide a redundant locking feature to hold the two shells together to form the toy ball.

Finally, U.S. Pat. No. 5,409,414, issued to Sheang, and entitled "Toy sphere" teaches a toy sphere that includes an annular member provided with a circular groove at both sides, a plurality of internal gear teeth at an inner surface, and two opposite eccentric pins at an outer surface, a power seat threadedly engaged with the internal gear teeth of the annular member and having a motor electrically connected with batteries, an upper hemispherical housing having internal threads, a lower hemispherical housing having external threads engageable with the internal threads of the upper hemispherical and having two aligned holes engaged with the two opposite eccentric pins of the annular member.

SUMMARY OF THE INVENTION

The present invention is a sphere-shaped toy; with a retractable mechanism, that upon pressing the upper button ejects a cylindrical figure capable of transforming its original compact shape into a new entity, without the need to manipulate or add new parts to which corresponds a toy with characteristics described hereafter pursuant to the drawings that form an integral part of this submission.

In one embodiment, the present invention includes a toy with a retractable mechanism capable of transforming its original compact shape into a new entity, without the need to manipulate its parts or add new parts, comprising: a hollow sphere (1) provided with a cut on the lower part thereof (2), on the upper end a convex protuberance (3) is projected, provided with a modified asymmetric cylinder, which reduces its size in the upper end assimilating the neck of the body of the sphere (4), formed by two hinges of plastic material adjoined to both caps (5); and two internal springs that maintain these hinges under tension to maintain the body inside the sphere (6) which, when pressed, activates the operation of the main spring (7) in such a way that, when the sphere (1) receives a strike or is pressed, the internal body of the sphere (1) moves the body with the impact (4); constituting between the sphere (1) and the body (4) an identity different from an initial identity. In one aspect, the body (4) is out of the sphere (1), it is constituted at the head of the body. In another aspect, the body (4) is constituted by one single part, which provides it with a higher rigidity and resistance. In another aspect, the shape of the body (4) can display several aspects, depending on the targeted segment, from the type of color, pattern, among others, whether it is animal or human, the latter with either male, female, or asexual gender, or with the appearance of a baby, a child or an adult. In another aspect, the sphere (1) can allow for different variations, ranging from an oval shape, different colors or textures, or different faces, depending on the adhesive adjoined to the frontal, lateral and rear surfaces.

In one embodiment, the present invention includes a method of deploying a toy comprising: providing a hollow sphere (1) with a cut on the lower part thereof (2), and on the upper end a convex protuberance (3) is projected, provided with a modified asymmetric cylinder, which reduces its size in the upper end assimilating the neck of the body of the sphere (4), formed by two hinges of plastic material adjoined to both caps (5); placing two internal springs that maintain these hinges under tension to maintain the body inside the sphere (6) wherein, when pressed, the activates the operation of the main spring (7) in such a way that, when the sphere (1) receives a strike or is pressed, the internal body of the sphere (1) moves the body with the impact (4); constituting between the sphere (1) and the body (4) an identity different from an initial identity. In another aspect, the body (4) is outside of the sphere (1), the sphere (1) that forms a head of a character. In another aspect, the body (4) is constituted by one single part, which provides it with a higher rigidity and resistance. In another aspect, the shape of the body (4) can display several aspects, depending on the targeted segment, from the type of color, pattern, among others, whether it is animal or human, the latter with either male, female, or asexual gender, or with the appearance of a baby, a child or an adult. In another aspect, the sphere (1) can allow for different variations, ranging from an oval shape, different colors or textures, or different faces, depending on the adhesive adjoined to the frontal, lateral and rear surfaces.

In one embodiment, the present invention includes a toy with a retractable mechanism capable of transforming its original compact shape into a new entity, without the need to manipulate its parts or add new parts, consisting essentially of: a hollow sphere (1) provided with a cut on the lower part thereof (2), on the upper end a convex protuberance (3) is projected, provided with a modified asymmetric cylinder, which reduces its size in the upper end assimilating the neck of the body of the sphere (4), formed by two hinges of plastic material adjoined to both caps (5); and two internal springs that maintain these hinges under tension to maintain the body inside the sphere (6) which, when pressed, activates the operation of the main spring (7) in such a way that, when the sphere (1) receives a strike or is pressed, the internal body of the sphere (1) moves the body with the impact (4); constituting between the sphere (1) and the body (4) an identity different from an initial identity. In another aspect, the body (4) is out of the sphere (1), it is constituted at the head of the body. In another aspect, the body (4) is constituted by one single part, which provides it with a higher rigidity and resistance. In another aspect, the shape of the body (4) can display several aspects, depending on the targeted segment, from the type of color, pattern, among others, whether it is animal or human, the latter with either male, female, or asexual gender, or with the appearance of a baby, a child or an adult. In another aspect, the sphere (1) can allow for different variations, ranging from an oval shape, different colors or textures, or different faces, depending on the adhesive adjoined to the frontal, lateral and rear surfaces.

In one embodiment, the present invention includes a toy with a retractable mechanism capable of transforming its original compact shape into a new entity, without the need to manipulate its parts or add new parts, consisting of: a hollow sphere (1) provided with a cut on the lower part thereof (2), on the upper end a convex protuberance (3) is projected, provided with a modified asymmetric cylinder, which reduces its size in the upper end assimilating the neck of the body of the sphere (4), formed by two hinges of plastic material adjoined to both caps (5); and two internal springs that maintain these hinges under tension to maintain the body inside the sphere (6) which, when pressed, activates the operation of the main spring (7) in such a way that, when the sphere (1) receives a strike or is pressed, the internal body of the sphere (1) moves the body with the impact (4); constituting between the sphere (1) and the body (4) an identity different from an initial identity.

BRIEF DESCRIPTION OF THE DRAWINGS

For a more complete understanding of the features and advantages of the present invention, reference is now made to the detailed description of the invention along with the accompanying figures and in which:

FIGS. 2A and 2B that toy, in which FIG. 2A shows a cross-section view of the toy in an extended position. FIG. 2B shows the internal mechanism that moves the internal body, and FIG. 2B shows the opposite side of the toy showing the locations for screws.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not limit the invention, except as outlined in the claims.

Figure 1:
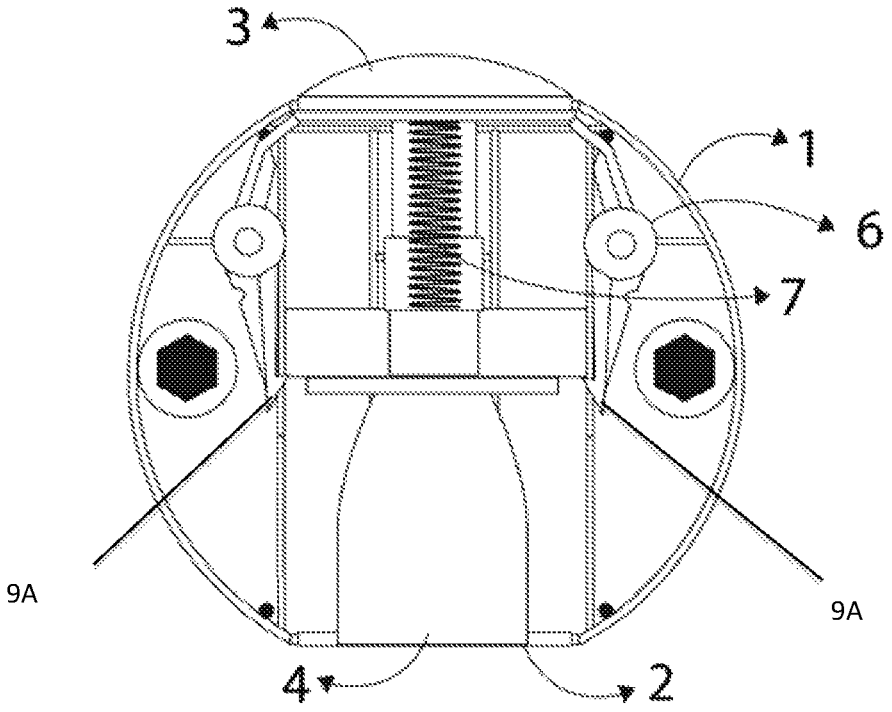
FIG. 1 shows a cross-section view of the toy in a compact position of the present invention.

As shown in FIGS. 1 to 8, the present invention for which registration is hereby sought is directed to a toy. FIG. 1 shows a cross section view of the toy of the present invention that is composed of a hollow sphere (1), provided with a cut or opening in the lower part thereof (2) which upon pressing the button in the upper part of the sphere (3), and without losing its original design ejects a retractable body (4) that allows the sphere to remain in standing position integrated by two hinges (9A, 9B) made of plastic material adjoining both caps (5) and one or more internal springs (7) that maintain these hinges (9A, 9B) under tension to maintain the body within the hollow sphere (1). At the top of the hollow sphere (1), a convex protuberance or button (3) is projected which, when pressed, activates the operation of the one or more springs (7) together with the lateral springs at pivot (6) cause the ejection of the body (4) from the hollow sphere (1) through opening or cut (2). The body (4) is shown as a modified asymmetrical cylinder, which reduces its size at the higher end assimilating the neck of the body (4) of the hollow sphere (1), in such a way that, when pressing the top button (3) or throwing the sphere and such button is hit, it activates the movement of the pivot (6) and springs (7), thus moving the body (4) with the impact, in such a way that as soon as the body (4) is out, the hollow sphere (1) is constituted at the head of the body (4), and together the hollow sphere (1) and the body (4) constitute an identity different from the initial one.

In addition, the body (4) displays the important characteristic of being formed by one single part, which provides it with a higher rigidity and resistance. The shape of the body (4) will typically be cylindrical, but also encompass the possibility of variations depending on the targeted segment, ranging from the type of color, pattern, among others, whether it is animal or human, the latter with either male, female, or asexual gender, or with the appearance of a baby, a child or an adult. The hollow sphere (1) can also allow for different variations, ranging from an oval shape, different colors or textures, or different faces, depending on the adhesive adjoined to the frontal, lateral and rear surfaces.

Figure 2A:
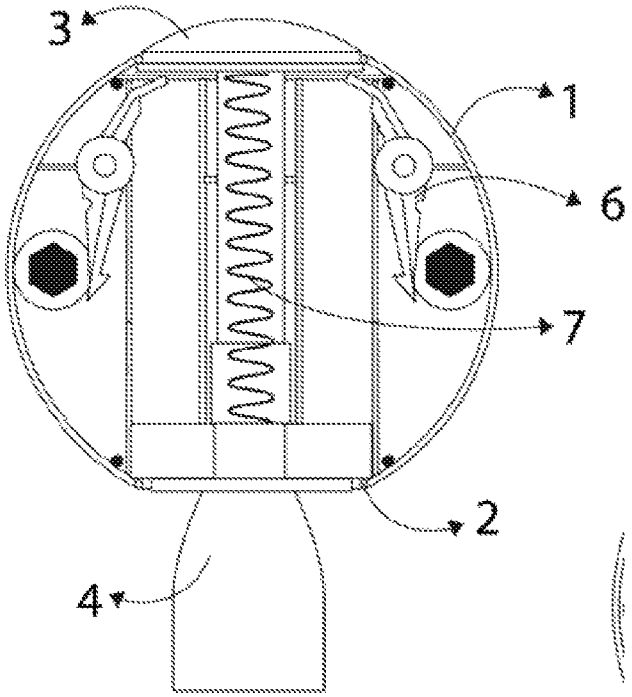
Figure 2B:
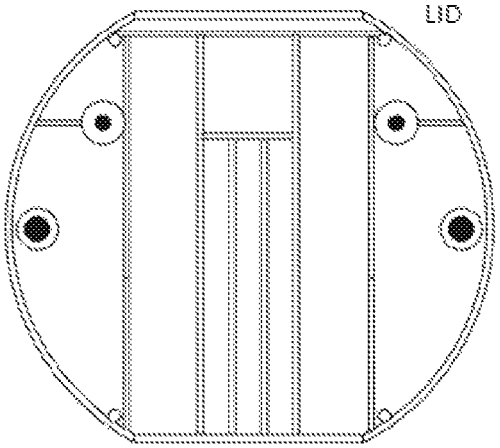

FIGS. 2A and 2B show a cross sectional view of one side of the hollow sphere (1) showing the body (4) in an extended position, as well as the spring(s) (7) in an extended position. The body (4) traverses the opening or cut (2) in the hollow sphere (1), and the position for the hinges and screws (not shown) that hold the two hemispheres (FIG. 2A being one hemisphere and FIG. 2B the other), of the hollow sphere (1) together are also shown.

Figure 3:
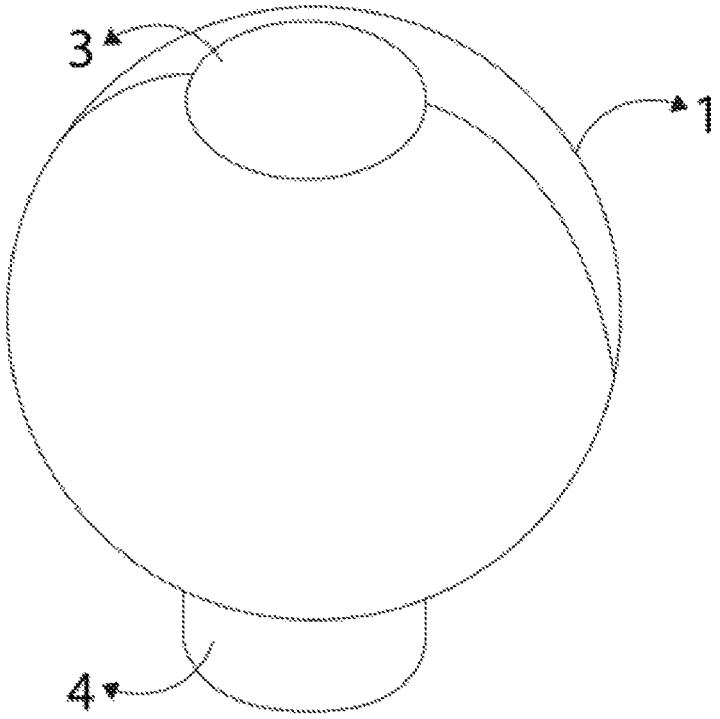
FIG. 3 shows a perspective view of the toy in an extended position.

FIG. 3 shows a perspective view of the toy in an extended position. FIG. 3 shows the relative position of the top button (3) with respect to the hollow sphere (1) and the body (4) shown in this example in an extended position.

Figure 4:
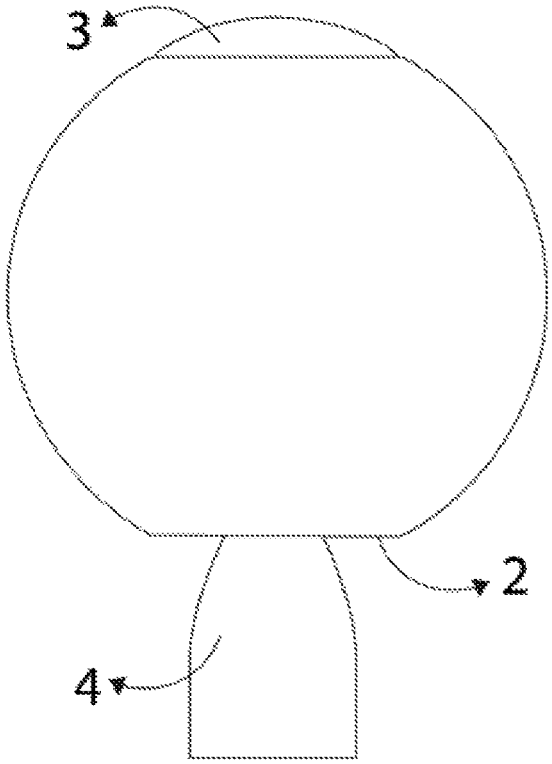
FIG. 4 shows a frontal elevation view of the toy in an extended position.

FIG. 4 shows a frontal elevation view of the toy in an extended position. FIG. 4 shows the relative position of the top button (3) with respect to the hollow sphere (1) and the body (4) shown in this example in an extended position through opening or cut (2).

Figure 5:
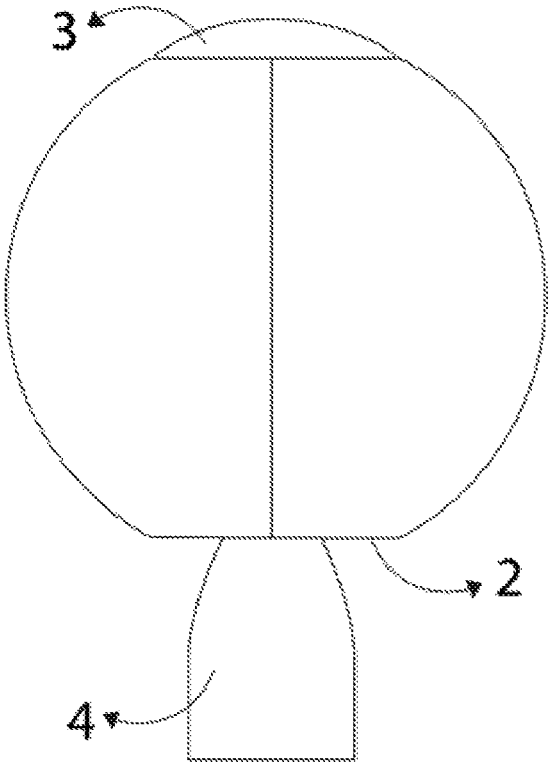
FIG. 5 shows a right profile view of the toy in an extended position.

FIG. 5 shows a right profile view of the toy in an extended position. FIG. 5 shows the relative position of the top button (3) with respect to the two halves of the hollow sphere (1) and the body (4) shown in this example in an extended position through opening or cut (2).

Figure 6:
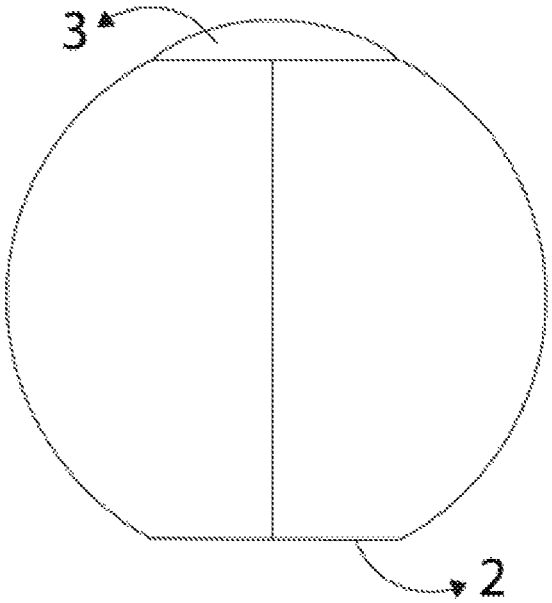
FIG. 6 shows a right profile view of the toy in a compact position.

FIG. 6 shows a right profile view of the toy in a compact position. FIG. 6 shows the relative position of the top button (3) with respect to the two halves of the hollow sphere (1) and the body (4) shown in this example in a compact or non-extended position in relation to the opening or cut (2).

Figure 7:
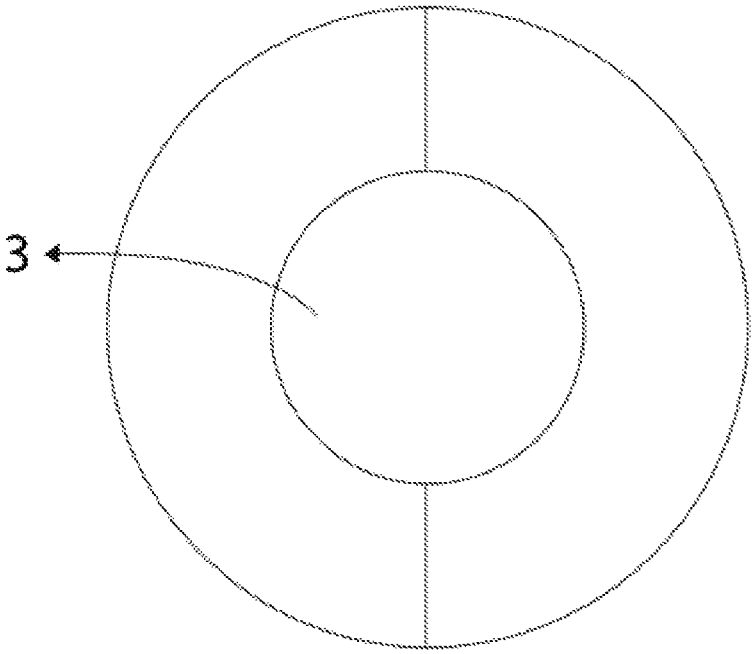
FIG. 7 shows an upper level view of the toy in an extended position.

FIG. 7 shows an upper level view of the toy in an extended position. FIG. 7 shows the relative position of the top button (3) with respect to the two halves of the hollow sphere (1).

Figure 8:
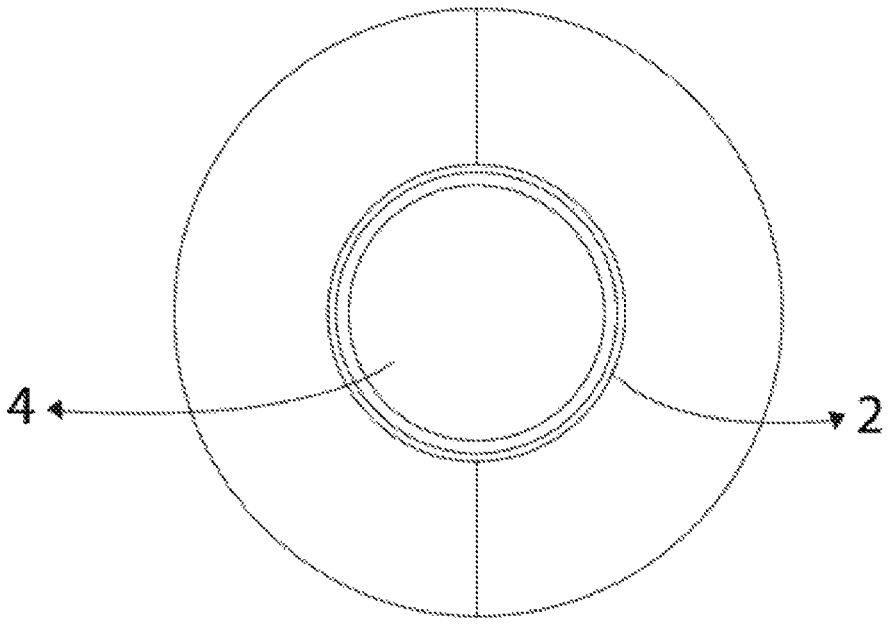
FIG. 8 shows a lower level view of the toy in an extended position.

FIG. 8 shows a lower level view of the toy in an extended position. FIG. 8 shows the relative position of the body (4) with respect to the two halves of the hollow sphere (1) and the body (4) shown in this example in a compact or non-extended position in relation to the opening or cut (2).

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112, U.S.C. § 112 paragraph (f), or equivalent, as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. A toy with a retractable mechanism capable of transforming its original compact shape into a new entity, without the need to manipulate its parts or add new parts, comprising:

a hollow sphere provided with an opening on a lower part thereof, and on an upper end with a convex protuberance;

a retractable body inside the hollow sphere, wherein a retractable body is within the hollow sphere by two hinges that pivot outwardly; and two internal lateral springs that maintain the two hinges under tension to maintain the retractable body in the hollow sphere which, when the convex protuberance receives a strike or is pressed, the convex protuberance pushes the two hinges that retain the retractable body to pivot outwardly and a main vertical spring pushes the retractable body through the opening to an outside of the hollow sphere, wherein the hollow sphere becomes a head of a new identity and the retractable body that has an identity different from an initial identity of the hollow sphere and wherein the retractable body can rotate about a longitudinal axis of the toy in a standing position.

2. The toy of claim 1, wherein the inside body is constituted by one single part, which provides it with a higher rigidity and resistance.

3. The toy of claim 1, wherein a shape of the retractable body, the hollow sphere, or both display one or more aspects, depending on a targeted segment, selected from a type of color, pattern, among others, whether it is animal or human, either male, female, or asexual gender, or with an appearance of a baby, a child or an adult.

4. The toy of claim 1, wherein the hollow sphere has different variations, ranging from an oval shape, different colors or textures, or different faces, depending on a adhesive adjoined to a frontal, a lateral and one or more rear surfaces.

5. A method of deploying a toy comprising:

providing a hollow sphere provided with an opening on a lower part thereof, and on an upper end with a convex protuberance;

inserting a retractable body inside the hollow sphere, wherein a retractable body is within the hollow sphere by two hinges that pivot outwardly; and using two internal lateral springs that maintain the two hinges under tension to maintain the retractable body in the hollow sphere which, when the convex protuberance receives a strike or is pressed, the convex protuberance pushes the two hinges that retain the retractable body to pivot outwardly and a main vertical spring pushes the retractable body through the opening to an outside of the hollow sphere, wherein the hollow sphere becomes a head of a new identity and the retractable body that has an identity different from an initial identity of the hollow sphere and wherein the retractable body can rotate about a longitudinal axis of the toy in a standing position.

6. The method of claim 5, wherein when the retractable body is outside of the hollow sphere, the hollow sphere forms a head of a character.

7. The toy of claim 6, wherein when the retractable body is constituted by one single part, which provides it with a higher rigidity and resistance.

8. The toy of claim 6, wherein a shape of the retractable body, the hollow sphere, or both, display one or more aspects, depending on a targeted segment, selected from a type of color, pattern, among others, whether it is animal or human, male, female, or asexual gender, or with an appearance of a baby, a child or an adult.

9. The toy of claim 6, wherein the hollow sphere has one or more variations, ranging from an oval shape, different colors or textures, or different faces, depending on an adhesive adjoined to a frontal, a lateral and one or more rear surfaces.

10. The method of claim 5, wherein the retractable body is constituted by one single part, which provides it with a higher rigidity and resistance.

11. The method of claim 5, wherein the shape of the retractable body or the hollow sphere, or both display one or more aspects, depending on a targeted segment, selected from a type of color, pattern, among others, whether it is animal or human, either male, female, or asexual gender, or with an appearance of a baby, a child or an adult.

12. The method of claim 5, wherein the hollow sphere has different variations, ranging from an oval shape, different colors or textures, or different faces, depending on a adhesive adjoined to a frontal, a lateral and one or more rear surfaces.

13. A toy with a retractable mechanism capable of transforming its original compact shape into a new entity, without a need to manipulate its parts or add new parts, consisting essentially of:

a hollow sphere provided with an opening on a lower part thereof, and on an upper end with a convex protuberance;

a retractable body inside the hollow sphere, wherein a retractable body is within the hollow sphere by two hinges that pivot outwardly; and two internal lateral springs that maintain the two hinges under tension to maintain the retractable body in the hollow sphere which, when the convex protuberance receives a strike or is pressed, the convex protuberance pushes the two hinges that retain the retractable body to pivot outwardly and a main vertical spring pushes the retractable body through the opening to an outside of the hollow sphere, wherein the hollow sphere becomes a head of a new identity and the retractable body that has an identity different from an initial identity of the hollow sphere and wherein the retractable body can rotate about a longitudinal axis of the toy in a standing position.

14. A toy with a retractable mechanism capable of transforming its original compact shape into a new entity, without a need to manipulate its parts or add new parts, consisting of:

a hollow sphere provided with an opening on a lower part thereof, and on an upper end with a convex protuberance a retractable body inside the hollow sphere, wherein a retractable body is within the hollow sphere by two hinges that pivot outwardly; and two internal lateral springs that maintain the two hinges under tension to maintain the retractable body in the hollow sphere which, when the convex protuberance receives a strike or is pressed, the convex protuberance pushes the two hinges that retain the retractable body to pivot outwardly and a main vertical spring pushes the retractable body through the opening to an outside of the hollow sphere, wherein the hollow sphere becomes a head of a new identity and the retractable body that has an identity different from an initial identity of the hollow sphere and wherein the retractable body can rotate about a longitudinal axis of the toy in a standing position.

* * * * *